US005735730A

United States Patent [19]

Jonemo et al.

[11] Patent Number: 5,735,730

[45] Date of Patent: Apr. 7, 1998

[54] DISHWASHER WITH VALVE MEANS FOR SEPARATING GRANDULES FROM DISHWATER

[75] Inventors: Per Jonemo, Malmo; Rolf Lindqvist, Hollviken, both of Sweden

[73] Assignee: GS Development AB, Malmo, Sweden

[21] Appl. No.: 679,311

[22] PCT Filed: Feb. 26, 1993

[86] PCT No.: PCT/SE93/00167

§ 371 Date: Sep. 2, 1994

§ 102(e) Date: Sep. 2, 1994

[87] PCT Pub. No.: WO93/17610

PCT Pub. Date: Sep. 16, 1993

Related U.S. Application Data

[63] Continuation of Ser. No. 302,727, Sep. 2, 1994, abandoned.

[30] Foreign Application Priority Data

Mar. 3, 1992 [SE] Sweden ..... 9200639

[51] Int. Cl.[6] ..... B24C 9/00; B24C 35/00; B08B 3/04

[52] U.S. Cl. ..... 451/87; 134/109; 210/420

[58] Field of Search ..... 49/41; 134/58 D, 134/109, 110, 111; 210/407, 420, 424; 451/87, 88, 103

[56] References Cited

U.S. PATENT DOCUMENTS

| | | | |
|---|---|---|---|
| 2,621,505 | 12/1952 | Smith | 134/110 |
| 3,640,023 | 2/1972 | Field et al. | 451/88 |
| 4,184,961 | 1/1980 | Rynde et al. | 216/424 |
| 4,653,520 | 3/1987 | Alvemarker | 134/110 |
| 4,862,914 | 9/1989 | Weingarten | 210/424 |
| 5,056,275 | 10/1991 | Wada et al. | 451/87 |

FOREIGN PATENT DOCUMENTS

| | | | |
|---|---|---|---|
| A1 0 016 895 | 10/1980 | European Pat. Off. . | |
| 0195959 | 10/1986 | European Pat. Off. . | |
| B1 0 169 847 | 7/1988 | European Pat. Off. . | |
| B 454 839 | 6/1988 | Sweden . | |
| 1066790 | 1/1984 | U.S.S.R. | 451/88 |
| WO 84/03616 | 9/1984 | WIPO . | |

*Primary Examiner*—Timothy V. Eley

*Attorney, Agent, or Firm*—Merchant, Gould, Smith, Edell, Welter & Schmidt, P.A.

[57] ABSTRACT

A cleaning machine operating with granules having a pump for ejecting liquid optionally with or without granules which are heavier than the liquid, through nozzles against the goods to be cleaned in a treatment space (10) connected to the suction side of the pump via a bottom outlet (11). A granule valve having a socket (38) open at each en thereof is associated with the bottom outlet, said socket being guided for vertical displacement between the upper position with an opening at the lower end of the socket for drawing liquid with granules entrained therein by the pump from the treatment space at a lower level, and a lower position with the opening at the lower ned of the socket closed for drawing liquid only by the pump from a higher level at the upper end of the socket. A projecting circumferential flange (49) is provided on the socket (38) below the upper end thereof said flange forming together with a cap (44) provided over the socket, a labyrinth seal for preventing granules from being withdrawn together with the liquid.

11 Claims, 2 Drawing Sheets

DISHWASHER WITH VALVE MEANS FOR SEPARATING GRANDULES FROM DISHWATER

This is a File Wrapper Continuation of application Ser. No. 08/302,727, filed Sep. 2, 1994 now abandoned.

BACKGROUND OF THE INVENTION

The invention relates to a cleaning machine operating with granules including a pump for ejecting liquid optionally with or without granules heavier than the liquid, through nozzles against goods to be cleaned in a treatment space which is connected to the suction side of the pump via a bottom outlet having a granule valve associated therewith, said valve comprising a socket open at both ends, which is guided for vertical displacement between a position in which the lower end of the socket is raised from the bottom of the treatment space and the upper end of the socket is engaged with a stationary cap provided above the socket, to allow the pump to draw liquid with granules entrained therein from the treatment space at a lower level at the lower end of the socket, and a lower position wherein the lower end of the socket engages the bottom of the treatment space to allow the pump to draw liquid only from an upper level at the upper end of the socket, the granules being collected on the bottom of the treatment space.

The principle of allowing the pump to draw liquid from a lower level in the treatment space when the liquid shall contain granules, and from an upper level when liquid only shall be circulated through the treatment space, is disclosed in EP-B1-0 169 187 which discloses also an embodiment of the granule valve which is of the kind referred to above. It has been found that in a cleaning machine operating with granules, which has a granule valve of said embodiment, an unsatisfactory separation of the granules from the liquid may occur when liquid only is to be circulated through the treatment space due to the fact that heavy splashing is imparted to the liquid contained in the lower part of the treatment space, functioning as a liquid tank, when liquid under heavy pressure and in large quantity is ejected against the goods to be cleaned in the treatment space. By the movement of the liquid in the tank movement is imparted also to the granules resting on the bottom and then the granules can be withdrawn by the liquid drawn by the pump at the upper end of the socket, i.e. at the upper level.

EP-B1-0 195 959 describes a cleaning machine operating with granules having a granule valve which is also of the kind referred to above but wherein the risk of granules being withdrawn by the liquid to the pump when drawing from the upper level being eliminated by providing between the upper edge of the socket and the periphery of the cap a strainer, e.g. a filter cloth, which is so dense that no granules can pass therethrough. This is no satisfactory solution of the problem to prevent the granules from being withdrawn by the liquid when the pump is drawing from the upper level because the attachment of the strainer will be structurally complicated and the device requires extended service on the machine due to the fact that the strainer will easily be clogged by food rests and other contaminations in the liquid and, if said strainer comprises a filter cloth, has to be replaced from time to time.

In order to eliminate said disadvantages the cleaning machine operating with granules of the kind referred to above has obtained according to the invention the characterizing features of claim 1.

SUMMARY OF THE INVENTION

According to a preferred development of the invention it is proposed to provide over the bottom of the treatment space below the flange provided on the socket of the granule valve, a grid operating as a splash attenuator and having square apertures defined by vertical plates, said grid attenuating the movement of granules collected in the water in the lower part of the treatment space functioning as a liquid tank, where turbulence is imparted to the liquid by the liquid ejected from the nozzles.

BRIEF DESCRIPTION OF THE DRAWINGS

In order to explain the invention in more detail an illustrative embodiment thereof will be described closer below, reference being made to the accompanying drawings, wherein.

DETAILED DESCRIPTION OF THE PREFERRED EMBODIMENTS

Figure 1:
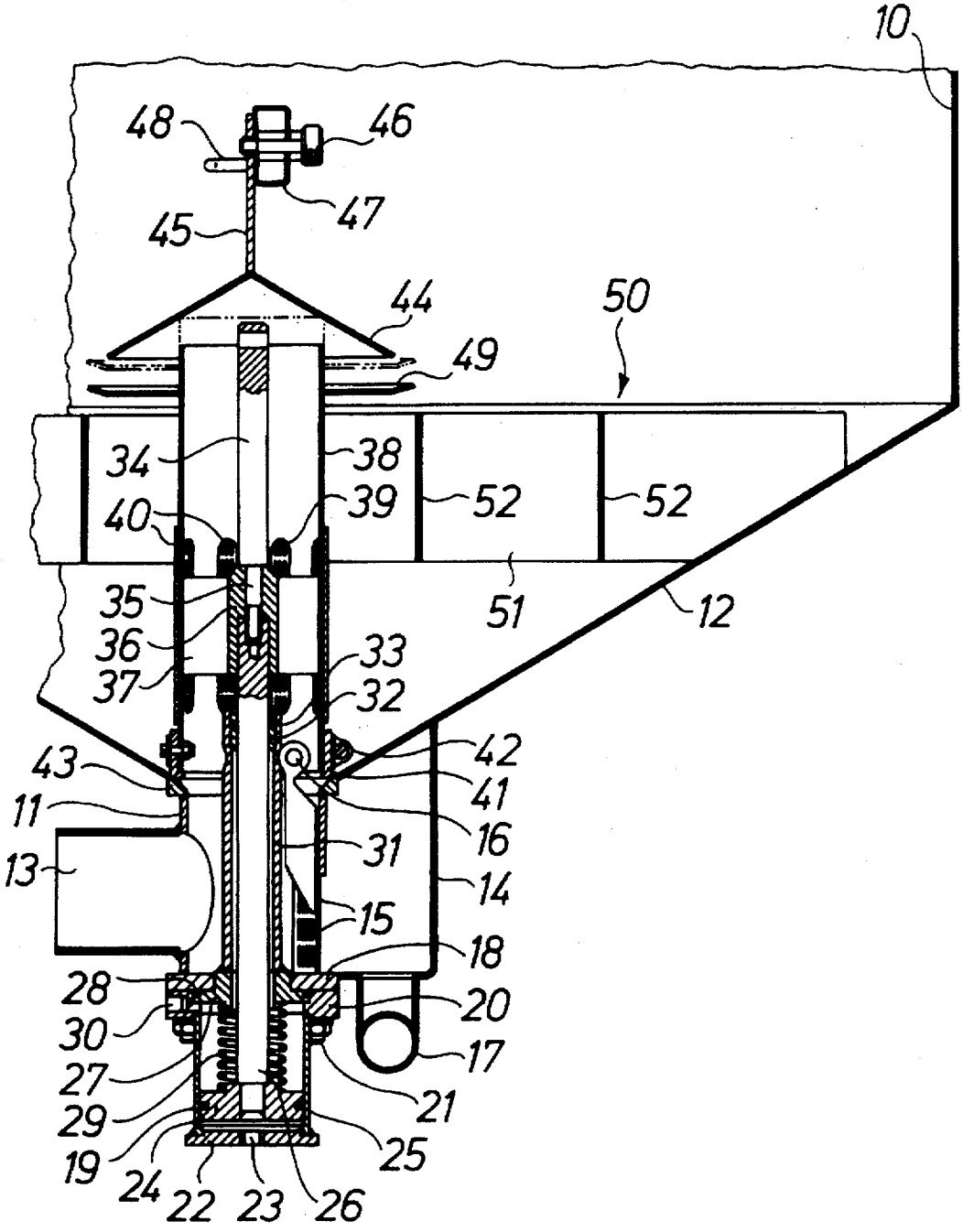
FIG. 1 is a fragmentary vertical cross sectional view of the lower part of a cleaning machine operating with granules according to the invention.

According to FIG. 1 the cleaning machine operating with granules comprises a parallelepipedic cabinet 10 having a bottom 12 sloping towards a bottom outlet 11 and having inverted pyramidic shape. The cabinet is made of stainless steel sheet and defines at the top thereof a treatment space for the goods to be cleaned, one or more racks for receiving said goods being provided in said treatment space as well as nozzle ramps for spraying the goods optionally with water having granules entrained therein or with water only. The arrangement of these components in the cleaning machine is well-known in the art and therefore has not been shown in more detail here. Moreover, it is unimportant to the invention how such components are arranged in detail. The granules used in the machine should be heavier than water and usually consist of small cylindrical bodies of plastics, e.g. polyamide. The lower part of the cabinet 10 forms a water tank for receiving water and granules ejected from the nozzles, and a circulation pump, not shown, is connected to the bottom outlet at a pipe stud 13 for drawing water, with or without granules, to be forwarded under pressure to the nozzles. Also an outlet chamber 14 is connected to the bottom outlet 11 via a strainer 15 which has apertures sufficiently small in order not to allow passage of granules, and which can be lifted from the bottom outlet from the interior of the cabinet 10, said strainer having for this purpose a handle 16. The outlet chamber 14 is connected to a valve controlled outlet pipe 17 which in turn is connected to a sewer.

The bottom outlet 11 terminates at the lower end thereof at a bottom plate 18 having a central aperture, and a cylinder 19 is connected to this bottom plate by means of an outer flange 20 and a bolt connection 21. The cylinder is provided with an end cover 22 welded to the cylinder and having a central threaded bore 23. A piston 24 is axially displaceable inside the cylinder, a piston seal 25 being provided in the piston to seal between the piston and the cylinder. The piston is provided with a piston rod 26 connected to the piston, which extends freely upwards from the piston through a flanged ring 27 which is clamped by means of the bolt connection between the flange 20 and the bottom plate 18 and is sealed against the bottom plate by means of an O-ring 28. A helical compression spring 29 is arranged between the ring 27 and the piston 24 and biases the piston to the lower end position shown. For displacement of the piston 24 upwards against the bias of the compression spring 29 a pressure fluid, preferably tap water under pressure, can be supplied to the cylinder 19 from a pressurized water conduit (not shown) which is connected to the threaded bore 23, ventilation of the cylinder space between the piston and the ring 27 being provided by means of a ventilation opening 30 in the ring.

On top of the ring 27 a pipe 31 is welded to the ring, and the piston rod 26 extends through this pipe and projects upwards from the upper end thereof where a guide bushing 32 having a sealing ring 33 is provided. A piston rod extension 34 is screwed into the upper end of the piston rod 26 at a threaded pin 35, and a spacer socket 36 is clamped between the piston rod and the piston rod extension. This spacer socket has a number of radially projecting flanges 37 which are connected to a circular-cylindrical valve drum 38 so that said drum is displaceable up and down together with the piston rod 26. In the lower half of the valve drum 31 a number axially extending slots 39 are provided said slots being covered on the outside by a strainer grid mounted around the valve drum, the passages through said grid being smaller than the granules so that the granules cannot pass through the strainer grid as long as they have not been worn to such dimension that they can no longer be used for the purpose thereof. At the lower end of the valve drum 38 a sealing ring 41 of an elastomer (rubber or plastics) is clamped by means of an encircling hose clamp 42 and this sealing ring has at the bottom thereof an inwardly directed flange to cover also the lower end edge of the valve drum. Under the bias of the compression spring 29 the valve drum 38 is kept with the sealing ring 41 in engagement with a valve seat 43 having a downwards tapering conical inside surface, and this valve seat is provided between the bottom 12 and the bottom outlet 11.

A conical cap 44 is demountably secured to a cross beam 47 inside the cabinet 10 by means of an outside metal sheet 45 connected to said cap, and a screw device 46, and a handle 48 is provided on the metal sheet 45 in order that the cap can be lifted out when it has been disconnected from the cross beam. The cap 44 extends peripherally beyond the valve drum 38 which has the upper end thereof slightly above the lower edge of the cap when the sealing ring 41 under the bias of the compression spring engages the valve seat 43. A flange 49 is connected to the valve drum 38 projecting radially therefrom and spaced below the upper end of the valve drum, said flange being spaced below the lower edge of the cap 44 when the valve drum is engaged with the valve seat, and moreover extends radially slightly beyond the lower edge of the cap 44.

It is assumed that pressurized water has been supplied to the cylinder 29 via the bore 23 a conduit being supposed to be connected to said bore, and that the piston 24 thus is displaced upwards against the bias of the compression spring 29, the upper end of the valve drum being engaged with the cap 44 as indicated by dot-and-dash lines in FIG. 1. This means that the sealing ring 41 is lifted from the valve seat 43. Water and granules ejected by means of the pump from the nozzles towards the goods to be cleaned, which is received in the treating space, will land on the bottom 12 and will again be drawn by the pump via the bottom outlet 11 and the pipe stud 13 to be ejected again from the nozzles. Thus, when the valve drum 38 is in the raised position the goods will be treated with liquid and granules entrained therein, which is circulated continuously by means of the pump. This treatment can be termed "water blasting". However, a cleaning process usually will be terminated by the goods being rinsed with water only in order that granules, if any, which adhere to the goods will be rinsed off, and such treatment with water only can also take place during the initial part of the cleaning process in order to rinse off food rests loosely adhering to the goods, before the "blasting" with granules is initiated. When the pump shall draw water only the valve drum 38 should be in the lowered end position which is shown in FIG. 1, and the valve drum is returned to this position by the compression spring 29 when the pressurized water is drained from the cylinder 19 through the bore 23. When the valve drum 38 shall land on the seat 43 it may very well happen—as has been found in practice—that two granules one located on top of the other will be clamped between the valve drum and the seat if the drum is engaged at the lower edge thereof directly against the seat. The consequence thereof will, of course, be that granules which land on the bottom 12 together with the water will be drawn by the pump and that no rinsing without granules can take place. Due to the fact that the sealing ring 41 is provided and consists of a relatively soft elastomer and that the sealing ring is engaged with an internal conical surface on the seat 43 this drawback will be eliminated. It has been found that at the sealing ring such flow conditions will arise that there is no tendency of one granule being located upon the other and that individual granules which per chance will be clamped between the sealing ring and the seat will be pressed into the sealing ring so that there is nevertheless obtained a tight engagement between the sealing ring and the seat. When the valve drum 38 is in the lower position the granules will be collected on the bottom 12 and water only will be passed to some degree through the apertures 39 via the strainer 40 when the water flow eventually will be limited by the granules being packed against the strainer, the main part of the water flowing into the valve drum 38 via the upper edge thereof and then through the bottom outlet 11 and the pipe stud 13 to the suction side of the pump. Even if the granules are heavier than water there is a risk that the granules will be withdrawn with the water flow passing under the cap 44 into the valve drum 38 over the upper edge thereof but this risk is reduced considerably by the engagement of the flange 49 on the valve drum. This flange forms together with the cap 44 a labyrinth seal which effectively excludes the granules from the space under the cap 44. The position of the flange 49 on the valve drum 38, i.e. the distance of the flange from the upper edge of the valve drum, and the radial dimension of the flange have to be determined empirically because these parameters are depending on the dimensioning of the valve drum 38, the size and weight of the granules, the shape of the cabinet 10 and the rate of the circulating water flow. Preferably the edge portion of the flange is angled upwards as shown in FIG. 1 so that the flange can be said to have the shape of a shallow bowl with flat bottom.

Figure 2:
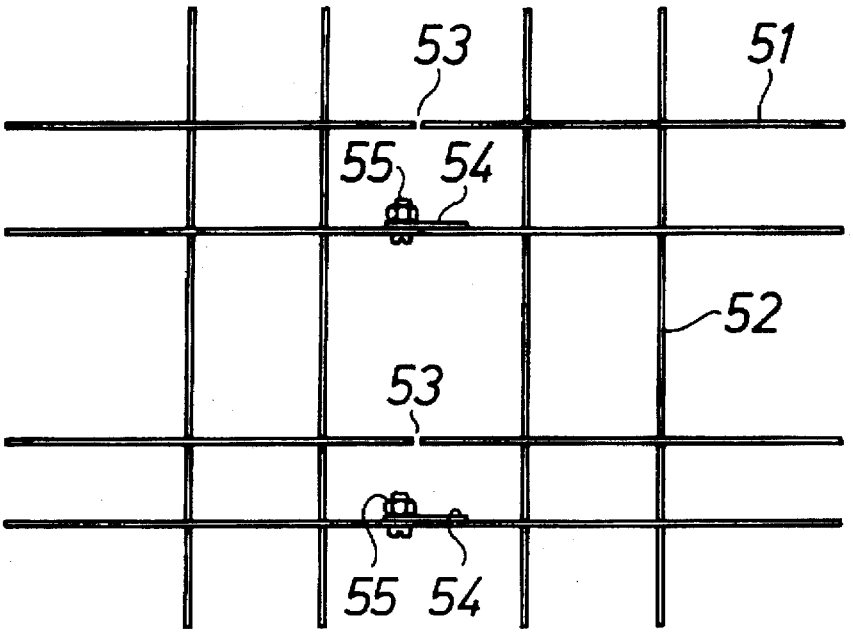
FIG. 2 is a plan view of a splash attenuator provided in the cleaning machine.
Figure 3:
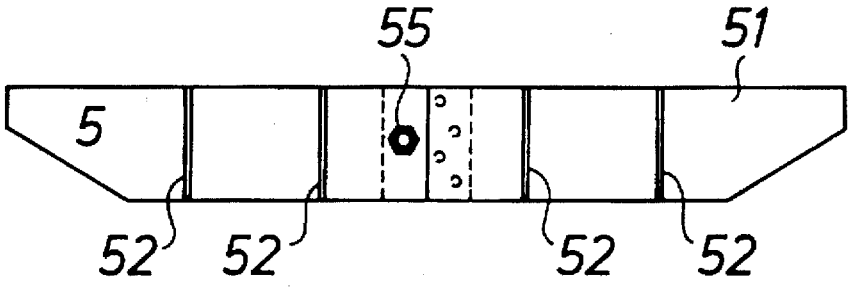
FIG. 3 is a side view of the splash attentuator as seen from the front side of the machine.
Figure 4:
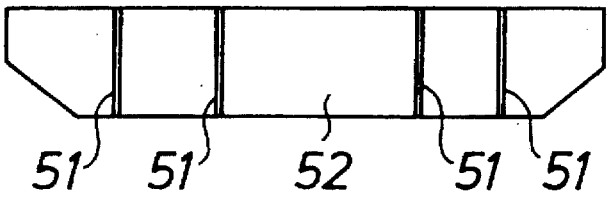
FIG. 4 is a side view of the splash attentuator as seen perpendicularly to the view of FIG. 3.

When the granules with the valve drum 38 in the closed position shown are being collected on the bottom 12 they will not land quietly on the bottom; on the contrary they will tend to move back and forth on the bottom due to the fact that a heavy splashing movement will be imparted to the water in the lower part of the cabinet 10 functioning as a water tank, by the water falling down in large quantity from the treatment space. Due to this agitation of the water and the granules in the water tank there is a risk that the granules dispite the weight thereof will be brought to move upwards in the water and that the granules as a consequence thereof may pass the labyrinth seal at the upper end of the valve drum. A further development of the invention therefore comprises a splash attenuating grid 50 which is provided on the bottom 12. This grid is shown also in FIGS. 2 and 3. It consists of longitudinal vertical plates 51 and transverse vertical plates 52 mutually crossing at right angles and interconnected by welding at the crossing sites. The longitudinal plates 51 are divided midway as shown at 53 two such plates being interconnected by a plate 54 attached by welding to one part and connected by bolt connection 55 to the other part. By this arrangement the splash attentuating grid can be more easily mounted to and demounted from the cleaning machine. When the grid is mounted in the cleaning machine the upper edge thereof is slightly spaced below the flange 49 when the valve drum 38 is in the closed position. The lower edge of the grid then rests against the bottom at the outer ends of the plates, which are obliquely cut at the bottom at the same angle as that formed by the bottom 12, the rest of the lower edge extending over the bottom spaced therefrom as will be seen from FIG. 1. The splash baffles formed by the grid attenuate the movement of the water and thus the movement of the granules collected on the bottom so that the granules will not be agitated in the water.

The flange 49 alone is sufficient in order to achieve the purpose of the invention but in large cleaning machines operating with granules and large water flows the splash attentuating grid is an advantageous complementary device sustaining the effect aimed at by the invention.

The valve drum can be operated in another way than that disclosed herein for example electrically or mechanically but because pressurized water is available when the cleaning machine is to be used the operating device disclosed herein is preferred.

We claim:

1. A cleaning machine operating with liquid and granules heavier than the liquid, comprising:

a treatment space for receiving goods to be cleaned said treatment space having a bottom;

nozzles in said treatment space;

a pump connected at a pressure side thereof to said nozzles for ejecting liquid through the nozzles against the goods received by said treatment space to be cleaned therein;

a bottom outlet in said treatment space the pump being connected at a suction side thereof to said bottom outlet;

a granule valve associated with said bottom outlet to control the flow therethrough; and wherein said valve includes a socket open at both ends, a stationary cap above said socket which is guided for vertical displacement between a position in which the lower end of the socket is raised from said bottom and the upper end of the socket is engaged with the stationary cap to allow the pump to draw liquid with granules entrained therein from a first level in the treatment space at the lower end of the socket, and a lower position wherein the lower end of the socket engages said bottom to allow the pump to draw liquid only from a second level in the treatment space at the upper end of the socket, the granules being collected on the bottom of the treatment space, and a projecting circumferential flange on the socket below the upper end thereof, said flange forming together with said cap a labyrinth seal for preventing granules from being withdrawn together with the liquid at the upper end of the socket when the socket is in said lower position.

2. A cleaning machine as in claim 1, wherein the cap is conical the apex thereof being directed upwards.

3. A cleaning machine as in claim 1, wherein said flange projects radially from the socket.

4. A cleaning machine as in claim 1, wherein said flange extends beyond the circumference of said cap.

5. A cleaning machine in claim 1, wherein said flange has an edge portion angled upwards so that the flange forms a shallow bowl with a flat bottom.

6. A cleaning machine as in claim 1, further comprising an elastic sealing ring mounted to the lower end of said socket to be engaged with said bottom.

7. A cleaning machine as in claim 6, wherein said elastic sealing ring extends under an end surface of said socket covering said end surface.

8. A cleaning machine as in claim 1, wherein said socket forms strainer apertures over a portion adjacent the lower end of the socket to allow passage of liquid while granules being separated therefrom.

9. A cleaning machine as in claim 1, further comprising a splash attenuating grid having square openings defined by vertical plates, said grid being located over said bottom below said flange.

10. A cleaning machine operating with liquid and granules heavier than the liquid, comprising:

a treatment space for receiving goods to be cleaned said treatment space having a bottom;

nozzles in said treatment space;

a pump connected at a pressure side thereof to said nozzles for ejecting liquid through the nozzles against the goods received by said treatment space to be cleaned therein;

a bottom outlet in said treatment space the pump being connected at a suction side thereof to said bottom outlet;

a granule valve associated with said bottom outlet to control the flow therethrough; and wherein said valve includes a socket open at both ends, a stationary cap above said socket which is guided for vertical displacement between a position in which the lower end of the socket is raised from said bottom and the upper end of the socket is engaged with the stationary cap to allow the pump to draw liquid with granules entrained therein from a first level in said treatment space at the lower end of the socket, and a lower position wherein the lower end of the socket engages said bottom to allow the pump to draw liquid only from a second level in said treatment space at the upper end of the socket, the granules being collected on the bottom of the treatment space, and a projecting circumferential flange on the socket below the upper end thereof, said flange extending beyond the circumference of said cap and forming together with the cap a labyrinth seal for preventing granules from being withdrawn together with the liquid at the upper end of the socket when the socket is in said lower position.

11. A cleaning machine operating with liquid and granules heavier than the liquid, comprising:

a treatment space for receiving goods to be cleaned said treatment space having a bottom;

nozzles in said treatment space;

a pump connected at a pressure side thereof to said nozzles for ejecting liquid through the nozzles against the goods received by said treatment space to be cleaned therein;

a bottom outlet in said treatment space the pump being connected at a suction side thereof to said bottom outlet;

a granule valve associated with said bottom outlet to control the flow therethrough, said valve including a socket open at both ends, a stationary cap above said socket which is guided for vertical displacement between a position in which the lower end of the socket is raised from said bottom and the upper end of the socket is engaged with the stationary cap to allow the pump to draw liquid with granules entrained therein from a first level in said treatment space at the lower end of the socket, and a lower position wherein the lower end of the socket engages said bottom to allow the pump to draw liquid only from a second level in said treatment space at the upper end of the socket, the granules being collected on the bottom of the treatment space, and a projecting circumferential flange on the socket below the upper end thereof, said flange forming together with said cap a labyrinth seal for preventing granules from being withdrawn together with the liquid at the upper end of the socket when the socket is in said lower position; and a splash attenuating grid located over the bottom below said flange said grid having square openings defined by vertical plates.

* * * * *